US006390336B1

(12) United States Patent
Orozco

(10) Patent No.: US 6,390,336 B1
(45) Date of Patent: May 21, 2002

(54) SPRAY WAND WITH STAND

(75) Inventor: Domingo Orozco, Spokane, WA (US)

(73) Assignee: Rolatape Corporation, Spokane, WA (US)

( * ) Notice: Subject to any disclaimer, the term of this patent is extended or adjusted under 35 U.S.C. 154(b) by 0 days.

(21) Appl. No.: 09/839,553

(22) Filed: Apr. 20, 2001

(51) Int. Cl.[7] ..... B67D 5/64
(52) U.S. Cl. ..... 222/162; 222/176; 239/150
(58) Field of Search ..... 222/162, 174, 222/176, 192; 239/150, 151, 273, 280, 532, 754

(56) References Cited

U.S. PATENT DOCUMENTS 2,638,730 A * 5/1953 Davidson ..... 239/150
2,893,606 A 7/1959 Hawkins
3,050,260 A * 8/1962 Macrae et al. ..... 239/150
3,064,904 A * 11/1962 Roberts ..... 239/150
3,871,557 A * 3/1975 Smrt ..... 222/174
4,099,482 A 7/1978 Smrt
4,524,912 A * 6/1985 Jones ..... 239/150
5,518,148 A 5/1996 Smrt
5,749,522 A * 5/1998 Smrt ..... 222/174
5,769,279 A 6/1998 Smrt

* cited by examiner

*Primary Examiner*—William C. Doerrler
*Assistant Examiner*—Thach H Bui
(74) *Attorney, Agent, or Firm*—Wells St. John P.S.

(57) ABSTRACT

A spray wand and stand is described, in which a canister holder is adjacent a bottom portion of an elongated framework. A stand is situated adjacent the canister holder and provide ground contact points with the framework that function to hold the framework in a position in which a handle end of the framework is elevationally above the canister holder.

14 Claims, 4 Drawing Sheets

SPRAY WAND WITH STAND

TECHNICAL FIELD

The present invention relates to spray wands of the type generally used to support a spray canister, and particularly to such a spray wand with a support stand.

BACKGROUND OF THE INVENTION

Spray paint is used to mark the ground, pavement or other surfaces. The paint may be supplied in aerosol cans with nozzles oriented axially with respect to the long axis of the aerosol can. Various holders have been developed to mount the aerosol cans, with remote operators that enable a user to walk or stand erect while operating the aerosol can to spray a mark on the ground surface.

One holder for marking and measuring is described in U.S. Pat. No. 4,099,482. This patent discloses a marking apparatus that includes a measuring device that will allow the marking apparatus to produce a series of equally spaced marks. A canister holder and actuator is provided at a bottom end of the device which is supported at the bottom end by a wheel. A measuring implement is slidably attached to the carrying frame and is useful to indicate distances from one spray-painted mark to the next. No stand or support arrangement is disclosed.

Another marking device is illustrated in U.S. Pat. No. 5,769,279. This is another form of marking device that mounts an aerosol container. However, this device includes a spike at the downward end of a support rod intended for producing a hole or opening in the ground surface. The hole is produced for receiving a marking flag or the like. The rod and trigger-actuating mechanism is otherwise similar to others previously known and used.

Other examples of an extended aerosol spray arrangement is shown in U.S. Pat. Nos. 2,893,606 and 5,518,148. This patent discloses an elongated support rod with a mounting device at one end for supporting a spray canister. A handle at an opposed end is provided with a trigger device that can be operated to remotely actuate the canister to dispense spray paint or other aerosol spray.

Of the above references, none disclose or suggest a spray wand and support stand that will enable a user to rest the unit in an upright condition. This is desirable, especially in situations where a user must temporarily leave the spray wand in an area such as a street or other location where the wand may not be conveniently placed on a truck bed or leaned against an object in an upright condition.

One of the general objectives of providing a remote actuated spray wand is to allow a user to operate the wand from an upright standing position. It is counterproductive and inefficient for the user who must bend to rest the wand on a horizontal surface when it is not in use, and then be required to bend once again to pick up the unit for further use. There is a need, therefore, for a spray wand that incorporates a form of support that will allow the wand to be used, yet stored or, temporarily positioned in an upright condition where the top end or handle of the wand is located for easy access.

An advantage to a spray wand having a stand is that the wand can be stored in an upright condition where it is clearly visible. Wands used in tall grass or cluttered areas are easily lost and unproductive time may be spent searching for lost apparatus. Further, there is little chance that the triggering mechanism will be operated with the wand supported in an upright orientation when not in use. The handle and trigger mechanism are held above the ground surface and are not easily activated unintentionally as can happen if the rod and handle portions are tipped to a horizontal condition and rested against a ground or other support surface where the trigger mechanism can be easily engaged and operated.

The present invention fills the above needs as will be understood from the following description which, taken with the accompanying drawings, exemplify preferred forms of the device.

BRIEF DESCRIPTION OF THE DRAWINGS

Preferred embodiments of the invention are described below with reference to the following accompanying drawings.

DESCRIPTION OF THE PREFERRED EMBODIMENTS

Figure 1:
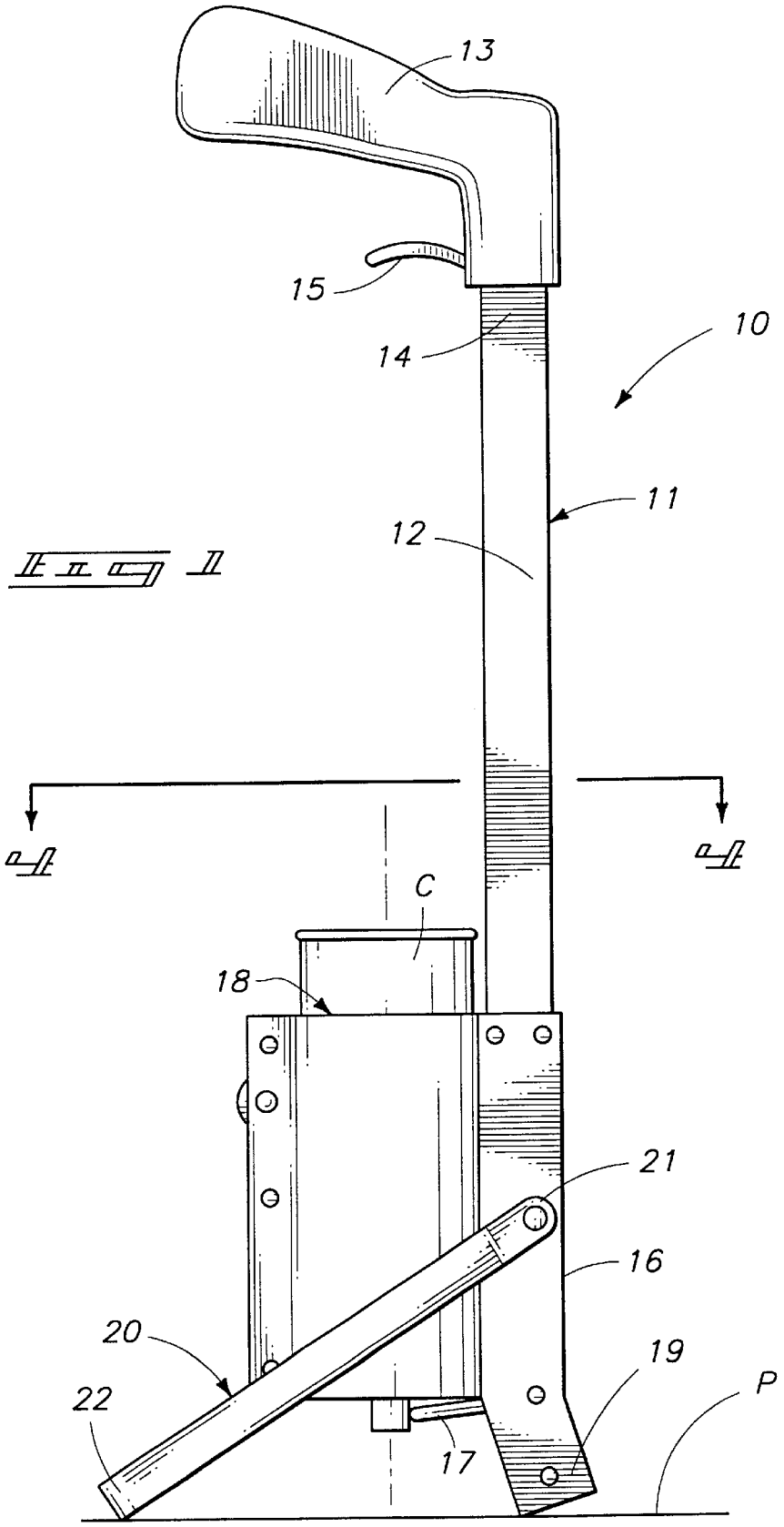
FIG. 1 is a side elevation view of a spray wand with stand.
Figure 2:
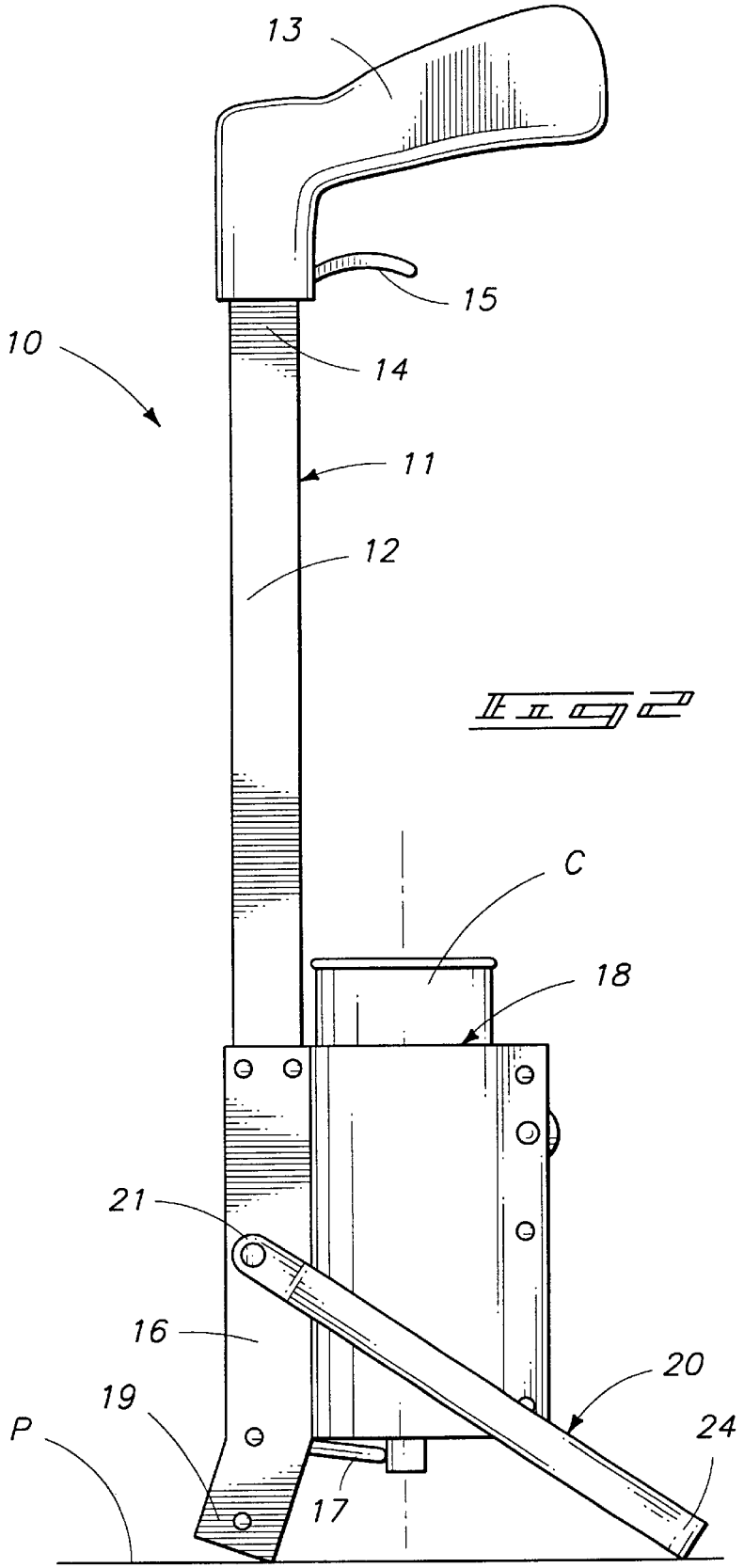
FIG. 2 is an elevation view of an opposite side thereof.
Figure 3:
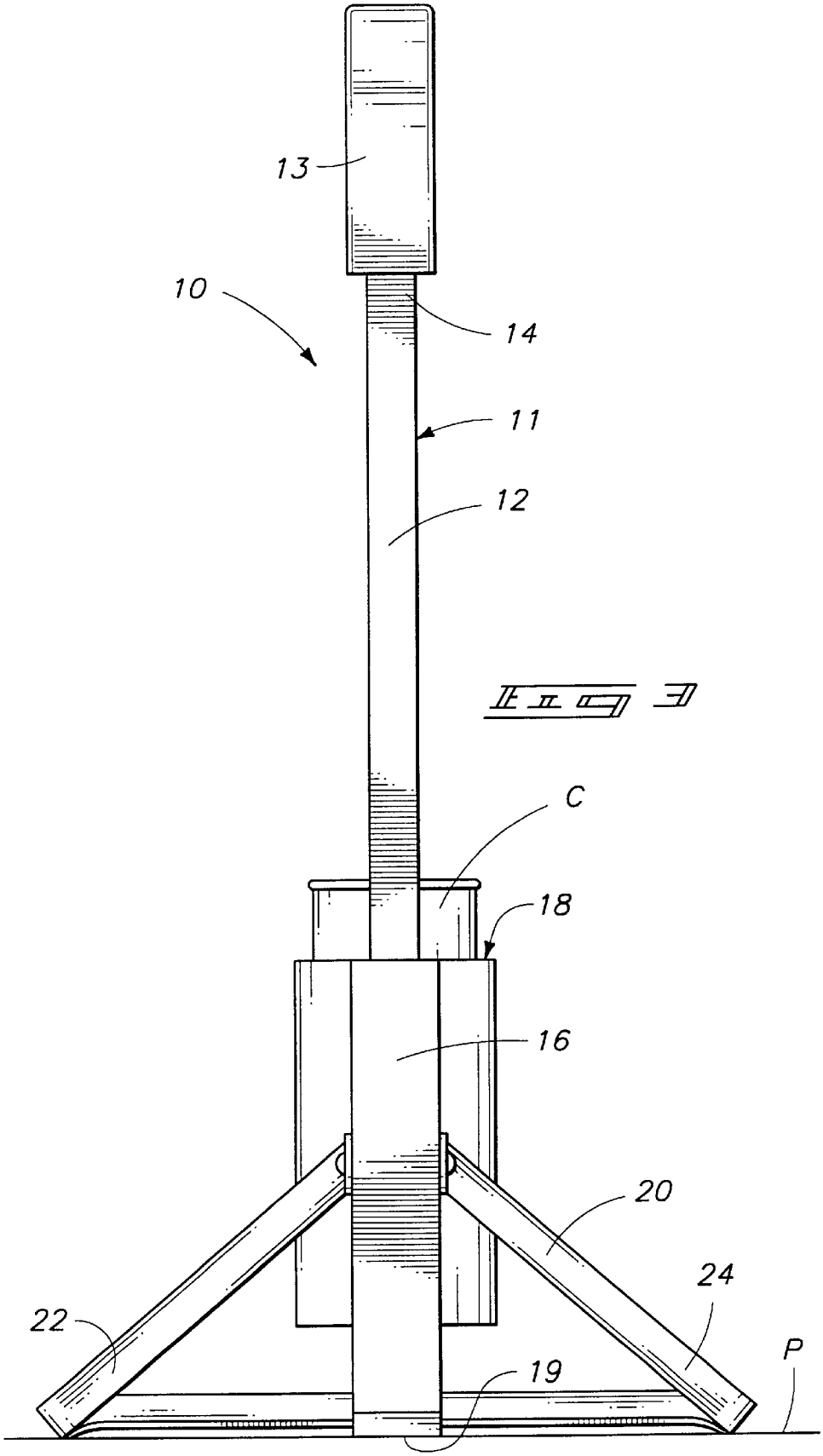
FIG. 3 is a front elevation view thereof.

This disclosure of the invention is submitted in furtherance of the constitutional purposes of the U.S. Patent Laws "to promote the progress of science and useful arts" (Article 1, Section 8).

General Description

Before a detailed description is given with respect to preferred features of exemplary embodiments, general descriptions will be given describing general aspects of the invention.

In one aspect the invention includes, a spray wand and stand 10 is comprised of an elongated framework 11 having a top 14 and a bottom portion 16. A canister holder 18 is provided adjacent the bottom portion 16. A stand 20 is operatively attached to one of the canister holder 18 and framework 11 at least adjacent the bottom portion 16 and shaped along with the framework to provide at least a three point support capable of holding the framework in an orientation in which the top end projects upwardly of the canister holder.

In another aspect, the invention includes a spray wand and stand 10 that includes an elongated bar 12 having a handle 13 at a top end 14 and a bottom portion 16 remote from the top end 14. A canister holder 18 is mounted to the bar 12 upwardly adjacent the bottom portion 16. A stand 20 is mounted to the bar adjacent the canister holder and projects therefrom to a pair of ground contact points 22, 24 that are disposed to opposed sides of the canister holder 18 and that define a substantially triangular three point ground support plane P with the bottom end 16 of the bar 12. The plane P is substantially normal to the elongated bar 12 such that the bar may be supported in a substantially upright orientation on a horizontal surface.

In another aspect the invention includes a spray wand and stand 10, in which an elongated bar 12 has a handle 13 at a top end 14 and a bottom portion 16 remote from the top end. A canister holder 18 is mounted to the bar 12 upwardly adjacent the bottom portion 16 of the bar. A triangle shaped stand 20 is formed about the canister holder 18 and is mounted at one corner 21 to the bar 12. The stand 20 further includes a pair of ground contact points 22, 24 that are disposed to opposed sides of the canister holder 18 and that define a substantially triangular three point ground support plane P with the bottom end 16 of the bar, such plane P being substantially normal to the elongated bar 12. The bar 12 may be supported in a substantially upright orientation on a horizontal surface and with the canister holder 18 situated within the triangular three point ground support plane P.

DETAILED DESCRIPTION

Referring now in more detail to the drawings and particular components of preferred forms of the invention, attention is drawn to FIGS. 1–4. There, the spray wand and stand 10 is shown including an elongated framework 11 that is exemplified as an elongated bar 12. The bar 12 is preferably formed in a hollow tubular construction that may be rectangular, circular, or other cross-sectional configuration. The bar 12 may be formed of any convenient at least semi-rigid material such as aluminum or an appropriate plastic, and may extend a desired distance according to the intended use between the top end 14 and the bottom portion 16.

A handle 13 may be provided at the top end 14 of bar 12. The handle may be formed of injection-molded plastic and be secured by rivets, adhesive, or other means to the top end of the bar. A trigger 15 may be provided at the top end of the bar and be connected to an appropriate linkage that extends along the interior of the bar to the bottom end 16 where it is connected to an actuator mechanism 17. Operation of the trigger 15 will cause a responsive motion of the actuator 17 to engage and open a valve on a canister C held within the canister holder 18. The trigger and operating linkage may be of conventional form such as shown in U.S. Pat. No. 5,518,148 which is hereby incorporated by reference in this application.

The canister C does not comprise part of the invention but may be understood to be a form of aerosol spray typically used in such applications for marking surfaces such as pavement, ground surfaces, grass and the like.

The canister holder 18 is preferably an open-ended tubular arrangement that is secured at one side to the bar 12. Preferably, the canister holder 18 is situated slightly above the bottom end 19 of the bottom portion 16. The canister holder may be secured to the bar by conventional means such as rivets, adhesive, mechanical fasteners, and the like. Further, the canister holder 18 may be formed of various materials such as injection-molded plastic, formed sheet-metal, or other appropriate material that may be fabricated into an open tubular configuration that will serve to support a canister C with the canister axis substantially parallel to the bar 12. In the illustrated example, a part of the canister holder forms the bottom portion 16 of the framework 11 and bar 12.

The stand 20 is preferably secured to the bar 12. In the exemplified form, the stand 20 is mounted to the bar and braced against the canister holder 18. In preferred forms, the stand 20 is comprised of a strap that is formed in a substantially triangular configuration with one corner 21 thereof secured to the bottom portion 16 on one side of the canister holder 18. The stand 20 may extend to opposite sides of the canister holder, to ground engaging points 22, 24. It is preferable that the points 22, 24 form a plane with the bottom end 19 of the bar. This plane P is preferably substantially normal to the elongated bar 12. Thus, when the three points are placed against a horizontal support surface, the bar will project upwardly in a substantially upright orientation.

The ground engaging points 22, 24 are preferably formed by crimped portions 25, 26 on the strap which offset a crossbar 27 (FIGS. 4,5) from the points 22, 24. This offset allows the points 22, 24 to be prominent, and the crossbar 27 to be spaced above the contact plane. The points 22, 24 and end 16 are thus the dominant contact areas for engaging and supporting the spray wand in a stable condition with the weight of the wand substantially centered within the three point contact area.

Figure 4:
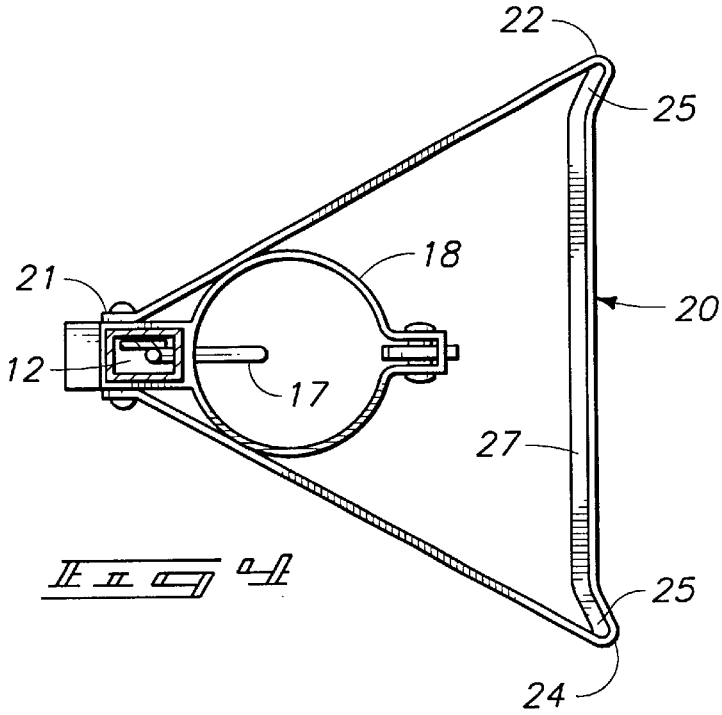
FIG. 4 is a sectional view taken substantially on line 3—3 and FIG. 1.
Figure 5:
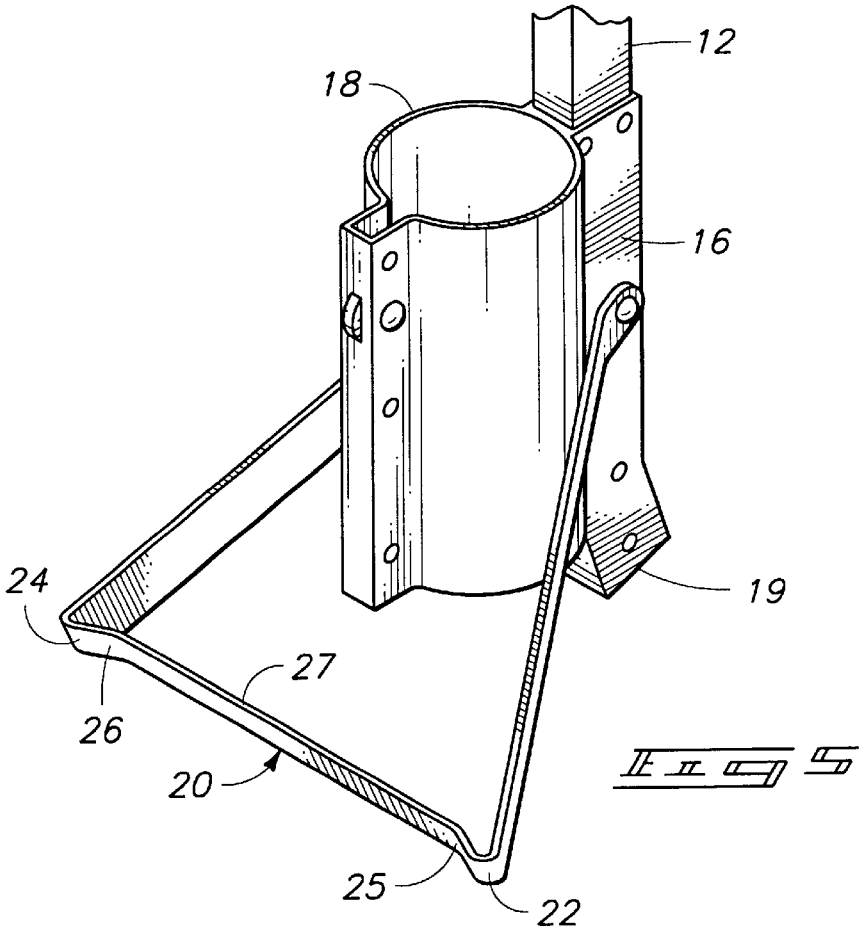
FIG. 5 is a fragmented perspective view of an exemplary canister holder and stand.

The canister holder 18 is preferably substantially centered or at least situated within the triangular configuration of the stand 20 (see FIG. 4). This is done to substantially center the weight of the canister holder and a canister held therein between the three point contact. Thus, the stand is substantially braced or the weight is centered such that the stand and spray wand are not easily tipped from the standing position.

The stand 20, as indicated above, is preferably formed of strap material. The preferred material may be an appropriate metal such as aluminum that can be easily bent into the preferred configuration shown. The corner 21 joining the bar 12 may be appropriately drilled to receive a threaded fastener as shown. However, it is also possible that the strap could be affixed by other means to the bar or, in possible alternate forms to the canister itself. Clearance, however, is provided within the triangular enclosure formed by the stand to allow free access to the canister holder from either end and to facilitate normal operation of the spray wand.

In operation, the spray wand with stand 10 is used in a conventional fashion, with the user standing or walking in an upright manner. The trigger mechanism may be used to activate the canister to spray material downwardly against the adjacent surface. When the spraying function is complete, the user may simply lower the spray wand until the three points (the bottom end 19, and points 22, 24) engage the support surface. These points are preferably spaced about the central of gravity support for the canister and therefore do not easily allow the bar or handle to readily tip or fall over. The spray wand can thus be left in the upright orientation indefinitely. The upright rod and handle are easily accessed once again when the user desires, without requiring bending to reach the handle.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A spray wand and stand, comprising:

an elongated framework having a top end and a bottom portion;

a canister holder adjacent the bottom portion;

a stand operatively attached to one of the canister holder and framework at least adjacent the bottom portion and shaped with the framework to provide a three point support capable of holding the framework in an orientation in which the top end projects upwardly of the canister holder; and wherein the stand is braced against the canister holder.

2. A spray wand and stand as defined by claim 1, wherein the stand is secured to the framework.

3. A spray wand and stand as defined by claim 1, wherein the stand is comprised of a strap formed in a substantially triangular configuration.

4. A spray wand and stand as defined by claim 1 wherein the framework is comprised of an elongated bar disposed to one side of the canister holder and wherein the stand extends from the bar to an opposite side of the canister holder.

5. A spray wand and stand as defined by claim 1 wherein the canister holder is comprised of an open ended tubular support attached on one side thereof to the framework.

6. A spray wand and stand as defined by claim 1 wherein the stand is comprised of a strap formed in a triangular configuration with two ground contact points at opposed ends of an offset crossbar portion, the two points being in a projecting ground engaging orientation with respect to the offset crossbar portion.

7. A spray wand and stand, comprising:

elongated bar having a handle at a top end and a bottom portion remote from the top end;

a canister holder mounted to the bar upwardly adjacent the bottom portion of the bar;

a stand mounted adjacent the canister holder and projecting therefrom to a pair of ground contact points disposed to opposed sides of the canister holder and defining a substantially triangular three point ground support plane with the bottom portion of the bar, such plane being substantially normal tops the elongated bar;

whereby the bar may be supported in a substantially upright orientation on a horizontal surface; and wherein the stand is braced against the canister holder.

8. A spray wand and stand as defined by claim 7, wherein the stand is secured to the bar at a location thereon adjacent the canister holder.

9. A spray wand and stand as defined by claim 7, wherein the stand is mounted to the bar.

10. A spray wand and stand as defined by claim 7, wherein the stand is comprised of a substantially rigid strap formed in a triangular configuration.

11. A spray wand and stand as defined by claim 7 wherein the bar is disposed to one side of the canister holder and the stand extends from the bar to an opposite side of the canister holder.

12. A spray wand and stand as defined by claim 7, wherein the canister holder is comprised of an open tubular support attached on one side thereof to the bar at a location thereon spaced toward the top end from the bottom portion.

13. A spray wand an stand as defined by claim 7, wherein the canister holder is comprised of an open ended tubular support attached on one side thereof to the bar at a location thereon spaced toward the top end from the bottom portion and wherein the stand is triangular, with one corner thereof attached to the bar and two corners projecting to opposed sides of the bar.

14. A spray wand, and stand, comprising:

an elongated bar having a handle at a top end and a bottom portion remote from the top end;

a canister holder mounted to the bar upwardly adjacent the bottom portion of the bar;

a triangle shaped stand formed about and braced against the canister holder and mounted at one corner to the bar; and wherein the stand further comprising a pair of ground contact points disposed to opposed sides of the canister holder and defining a substantially triangular three point ground support plane with a bottom end of the bar, such plane being substantially normal to the elongated bar; and whereby the bar may be supported in a substantially upright orientation on a horizontal surface and with the canister holder situated within the triangular three point ground support plane.

* * * * *

UNITED STATES PATENT AND TRADEMARK OFFICE

CERTIFICATE OF CORRECTION

PATENT NO. : 6,390,336 B1
DATED : May 21, 2002
INVENTOR(S) : Domingo Orozco

It is certified that error appears in the above-identified patent and that said Letters Patent is hereby corrected as shown below:

Column 5,
Line 15, insert the word -- an -- before "elongated bar".
Line 25, delete the word "tops" and insert the word -- to -- before "the elongated bar".

Column 6,
Line 6, insert the word -- ended -- after "open".
Line 9, delete the word "an" and insert the word -- and -- before "stand".
Line 16, delete the comma after "wand".

Signed and Sealed this

Third Day of December, 2002

JAMES E. ROGAN
*Director of the United States Patent and Trademark Office*